US012305330B2

(12) United States Patent
Böck et al.

(10) Patent No.: US 12,305,330 B2
(45) Date of Patent: May 20, 2025

(54) PAPER MACHINE CLOTHING AND USE OF SUCH A CLOTHING

(71) Applicant: Voith Patent GmbH, Heidenheim (DE)

(72) Inventors: Johann Böck, Fornach (AT); Jan Gallik, Weyregg (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 18/570,214

(22) PCT Filed: Jun. 3, 2022

(86) PCT No.: PCT/EP2022/065176
§ 371 (c)(1),
(2) Date: Dec. 14, 2023

(87) PCT Pub. No.: WO2022/263208
PCT Pub. Date: Dec. 22, 2022

(65) Prior Publication Data

US 2024/0279873 A1 Aug. 22, 2024

(30) Foreign Application Priority Data

Jun. 14, 2021 (DE) ..... 10 2021 115 275.5

(51) Int. Cl.
*D21F 7/08* (2006.01)
*D03D 11/00* (2006.01)
*D21F 1/00* (2006.01)

(52) U.S. Cl.
CPC ..... *D21F 1/0036* (2013.01); *D03D 11/00* (2013.01)

(58) Field of Classification Search
CPC ..... D21F 1/0036; D21F 1/0045; D03D 11/00
See application file for complete search history.

(56) References Cited

U.S. PATENT DOCUMENTS 5,544,678 A * 8/1996 Barrett ..... D21F 1/0045 139/383 A
6,179,013 B1 * 1/2001 Gulya ..... D21F 1/0045 139/383 A (Continued)

FOREIGN PATENT DOCUMENTS

DE 102013106327 A1 12/2014
WO 2008068317 A1 6/2008

*Primary Examiner* — Robert H Muromoto, Jr.
(74) *Attorney, Agent, or Firm* — Laurence A. Greenberg; Werner H. Stemer; Ralph E. Locher

(57) ABSTRACT

A clothing for a machine for producing or processing a material web has a first and a second woven layer. The clothing has more first longitudinal threads than second longitudinal threads, but the number of first longitudinal threads is at most twice as large as the number of second longitudinal threads. Transverse threads of the second woven layer form contact floats on the machine contact side. Longitudinal threads of the first and second woven layer in each weaving repeat are arranged a first group and a second group. In the first group the longitudinal threads of the first and second layers are arranged precisely one above the other in the thickness direction of the clothing, while in the second group neither of two longitudinal threads of the first layer is arranged precisely above a single longitudinal thread of the second woven layer in the thickness direction of the clothing.

19 Claims, 5 Drawing Sheets

(56) References Cited

U.S. PATENT DOCUMENTS

| | | | | |
|---|---|---|---|---|
| 7,059,357 | B2 * | 6/2006 | Ward | D21F 1/0045 442/205 |
| 7,604,025 | B2 * | 10/2009 | Quigley | D21F 1/0045 139/383 R |
| 7,743,795 | B2 * | 6/2010 | Quigley | D21F 1/0045 139/383 R |
| 7,806,147 | B2 * | 10/2010 | Hodson | D21F 1/0027 139/383 R |
| 7,861,747 | B2 * | 1/2011 | Quigley | D21F 1/0045 139/383 R |
| 8,652,302 | B2 * | 2/2014 | Boeck | D21F 1/0036 162/903 |
| 10,060,076 | B2 * | 8/2018 | Uymur | D03D 11/00 |
| 10,145,064 | B2 * | 12/2018 | Despault | D21F 1/0036 |
| 11,591,722 | B2 * | 2/2023 | Quigley | D03D 13/004 |
| 11,668,049 | B2 * | 6/2023 | Ueda | D03D 11/00 162/348 |
| 2004/0102118 | A1 * | 5/2004 | Hay | D21F 1/0036 442/181 |
| 2008/0196784 | A1 * | 8/2008 | Quigley | D21F 1/0045 139/383 R |
| 2009/0205739 | A1 * | 8/2009 | Quigley | D21F 1/0045 139/35 |
| 2009/0205740 | A1 | 8/2009 | Quigley | |

* cited by examiner

PAPER MACHINE CLOTHING AND USE OF SUCH A CLOTHING

FIELD AND BACKGROUND OF THE INVENTION

The invention relates to a clothing, in particular a forming screen, for a machine for producing or processing a material web, in particular a tissue web, comprising a first woven-fabric layer which provides a web material contact side and is formed by interweaving first longitudinal threads that run in the clothing longitudinal direction and first transverse threads that run in the clothing cross direction, and a second woven-fabric layer which provides a machine contact side and is formed by interweaving second longitudinal threads that run in the clothing longitudinal direction and second transverse threads that run in the clothing cross direction, wherein the first woven-fabric layer and the second woven-fabric layer are connected to one another by binding threads; wherein the clothing has more first longitudinal threads than second longitudinal threads, but the number of first longitudinal threads is at most double the number of second longitudinal threads; and wherein the weaving pattern of the clothing recurs in repeats, and the second transverse threads in each repeat form at least two contact flotations on the machine contact side. The invention furthermore relates to the use of such a clothing for producing a tissue web.

As clothings of this type are in most instances flat woven, the longitudinal threads are typically the warp threads, and the transverse threads are typically the weft threads, of the clothing. However, should the clothing be circular-woven, the exact reverse applies.

Such a clothing is known from publication WO 2008/068317 A1, for example. Owing to the fact that the clothing has more first longitudinal threads than second longitudinal threads, the first longitudinal threads can be of a finer configuration than the second longitudinal threads, and a particularly low-marking web material contact side can be provided in this way. The tensile stresses to which the clothing is subjected in the longitudinal direction can primarily be absorbed by the second longitudinal threads with a larger cross section.

In order to protect the second longitudinal threads, which are highly stressed for tension, against wear, the clothing is configured in such a manner that contact with the machine takes place primarily at the contact flotations of the second transverse threads. In flat-woven clothings, these are referred to as so-called "weft runners". In this way, the second transverse threads are subjected to particular wear in the intended use of the clothing. As it is generally assumed that the local wear decreases as the contact face increases, the flotations of the second transverse threads are in most instances configured to be relatively long on the machine side.

An issue which has been observed in known clothings of this type is that the transverse stability could be better. The transverse stability is important in order to avoid the clothing decreasing in size in the machine cross direction when said clothing is stressed for tension in the machine direction.

Publications US 2009 205740 A1 and US 2008 196784 A1 already disclose generic clothings, specifically the clothing described at the outset, in which all contact flotations of the second transverse threads have a length of at most two. In other words, the second transverse threads in one contact flotation should be guided below only one second longitudinal thread, or at most below two directly neighboring second longitudinal threads. It has been demonstrated that the transverse stability can be increased in comparison to that present in the clothing from WO 2008/068317 A1 by reducing the contact flotation length and accordingly increasing the number of contact flotations, without the wear on the second transverse threads increasing noticeably or even quantifiably. The latter applies in particular when the clothing is used as intended, as a forming screen in tissue machines. It is presumed that this has to do with the fact that no filler materials, or very minor quantities of the latter, are used in the production of tissue, filler materials having an abrasive effect on the clothing.

At the same time, the fact that more and shorter contact flotations are present than in the prior art has the effect that the contact flotations are more tightly interlaced as a result of the tauter binding. In other words, the thickness of the clothing is reduced in the region of the contact flotations. This effect is presumed to be the cause of the improved transverse stability which manifests itself in an increased stability in terms of the screen width on the paper machine.

The tighter interlacing moreover results in an advantageous secondary effect in terms of a reduction of the free volume within the clothing, undesirable entrained water being transported through said free volume.

A reduction of the free volume within the clothing also facilitates the de-watering of the material web transported on said clothing. This is particularly advantageous when this material web is a fibrous web, in particular a tissue web, with a low specific area weight. The production of such tissue webs requires particularly rapidly de-watering forming screens.

However, the de-watering performance could still be better in the clothings in US 2009 205740 A1 and US 2008 196784 A1.

SUMMARY OF THE INVENTION

It is an object of the present invention to solve this issue, i.e. to improve the de-watering performance, but without compromising the service life and the transverse stability with the afore-mentioned advantages of such a clothing.

The object is achieved by the device having the features according to of the independent claim(s). Further advantageous features are mentioned in the dependent claims.

According to the invention, the generic clothing is distinguished in that the first longitudinal threads and the second longitudinal threads in each repeat are disposed in a plurality of groups, specifically at least one first group and one second group, wherein the first group is formed from a first longitudinal thread and a second longitudinal thread which are disposed exactly on top of one another in the thickness direction of the clothing, while the second group is formed from two first longitudinal threads and one second longitudinal thread, wherein none of the two longitudinal threads of the second group is disposed exactly above the first longitudinal thread of the second group in the thickness direction of the clothing. As result of this special arrangement of the first and the second longitudinal threads it can be achieved that water from the tissue web, which passes through the first woven-fabric layer, can also flow relatively easily and on a direct path through the second woven-fabric layer. Rapid de-watering is promoted as a result.

This applies in particular when the first longitudinal threads and the second longitudinal threads are dimensioned and disposed relative to one another in such a manner that, when viewed projected in the thickness direction of the clothing, said threads within a repeat form at least one free longitudinal strip, wherein such a strip is preferably formed at all locations where individual groups are adjacent to one another.

In the context of this invention, "disposed exactly on top of one another" is understood to mean that the first longitudinal thread—when viewed projected in the thickness direction of the clothing—is not to protrude laterally beyond the second longitudinal thread. Minor displacements which may arise locally are however to be disregarded here.

A mutually different number of first and second groups is preferably provided in each repeat. Since the first and the second groups have a mutually dissimilar de-watering behavior, and thus marking behavior, it has been demonstrated that an irregularity in the marking pattern can be generated by the different number of first and second groups in the repeat, as a result of which the markings are significantly less visible.

Moreover, this design embodiment offers the possibility of influencing the de-watering behavior of the screen. It is therefore proposed, in one advantageous refinement of this concept of the invention, that the number of first groups differs from the number of second groups in the clothing. For example, if more first groups than second groups are used, a screen with a higher de-watering performance can be achieved than when more second than first groups are used. Conversely however, if more second groups than first groups are used, this has the advantage that the screen provides more support points to the fibrous web.

Especially with a view to a regular twill weave in the second woven-fabric layer, the appearance of the fibrous web, in particular a tissue web, can be influenced in a targeted manner with this type of arrangement of the first and the second longitudinal threads in different groups, in particular by way of the interaction of the diagonally oriented and longitudinally oriented hydraulic markings. The term "hydraulic marking" herein relates to a disturbance in the homogenous flow of the screen water through the screen during the de-watering and the sheet formation, this being caused by the presence of the longitudinal and transverse threads and their thread intersections.

In order to prevent the weaving pattern from becoming too complex, it is preferable that the second transverse threads form at most six contact flotations on the machine contact side in each repeat. Between two and four such contact flotations per repeat are typically sufficient.

It is moreover proposed that the binding threads always run in pairs beside one another in the clothing cross direction, wherein said binding threads, preferably in an alternating manner, continue a weaving pattern on the web material contact side. Such clothings are also referred to as SSB screens in the industry, SSB being an abbreviation for "sheet support binder".

In order to provide as many fiber-support points on the web contact side as possible, and in this way to configure the clothing to be as low-marking as possible, it is proposed that the first woven-fabric layer has a plain weave. It is to be noted here that the binding threads should be able to contribute toward the weaving pattern of the first layer. Thus, the plain weave is preferably achieved not solely by the first longitudinal threads and the first transverse threads, but also by the binding threads which furthermore preferably also extend substantially in the woven-fabric cross direction. Alternatively however, it is also possible that the first woven-fabric layer has a different weave, in particular a 2/1 twill weave, or a 3/1 twill weave, order a weave derived therefrom. This is particularly advantageous when a certain structuring of the fibrous web is even desirable, such as in tissue webs, for example. The binding threads can have substantially the same diameter as the first transverse threads and/or the first longitudinal threads. The term "substantially" in this context means that the diameters of these thread systems do not vary from one another by more than 30%.

The second woven-fabric layer, which does not come into contact with the material web, can have a plain weave or a twill weave. The twill weave is distinguished in that an obliquely running rib can be seen therein. This rib can continue without interruption over the entire clothing at all locations, and so this is referred to as a regular, non-interrupted twill weave, or else said rib may have certain variances, in particular interruptions or offsets, and so this is referred to as a broken or interrupted twill weave. Both types of twill weaves have proven suitable for the clothing according to the invention in practice. Regular twill weaves lead to thinner clothings than broken twill weaves, because interruptions in the twill rib lead to a greater height of the flotation in this region. Regular twill weaves can reproduce the diagonal, formed by them, by way of hydraulic interaction in the de-watered fibrous web, which is advantageous when a structured fibrous web is desirable. In contrast, broken twill ribs are typically reproduced in a less strongly hydraulic manner in the de-watered fibrous web. Multi-rib twills having different twill rib widths can moreover optimize the hydraulic marking potential.

It is to be noted that the binding threads are in principle not considered in the definition of the weaving pattern of the second layer, as opposed to the weaving pattern of the first layer.

It can moreover be provided that two neighboring contact flotations of a second transverse thread are mutually separated by at most two second longitudinal threads. As a result of the many intersection points in the second woven-fabric layer, the thickness of the latter can be relatively minor, and the second longitudinal threads can also be protected against wear. It can be achieved in particular that the second woven-fabric layer is of a relatively planar configuration, i.e. that this results in noteworthy protrusions also not being present on the web contact side, which protrusions would be subjected to particular wear.

In a refinement of this concept, it can even be provided that two neighboring contact flotations of a second transverse thread are always in each case mutually separated by only one second longitudinal thread.

A further aspect of the present invention relates to the use of a previously described clothing according to the invention for producing a tissue web, wherein the advantages of the clothing according to the invention become particularly salient when the tissue web has a low specific area weight, i.e. a specific area weight of at most 30 $g/m^2$, preferably between 8 $g/m^2$ and 30 $g/m^2$.

The clothing according to the invention is advantageously used as a forming screen in a so-called crescent former of a tissue machine.

BRIEF DESCRIPTION OF THE FIGURES

Further advantageous features of the invention will be explained by means of exemplary embodiments with reference to the drawings, in which.

DETAILED DESCRIPTION OF THE INVENTION

Figure 1:
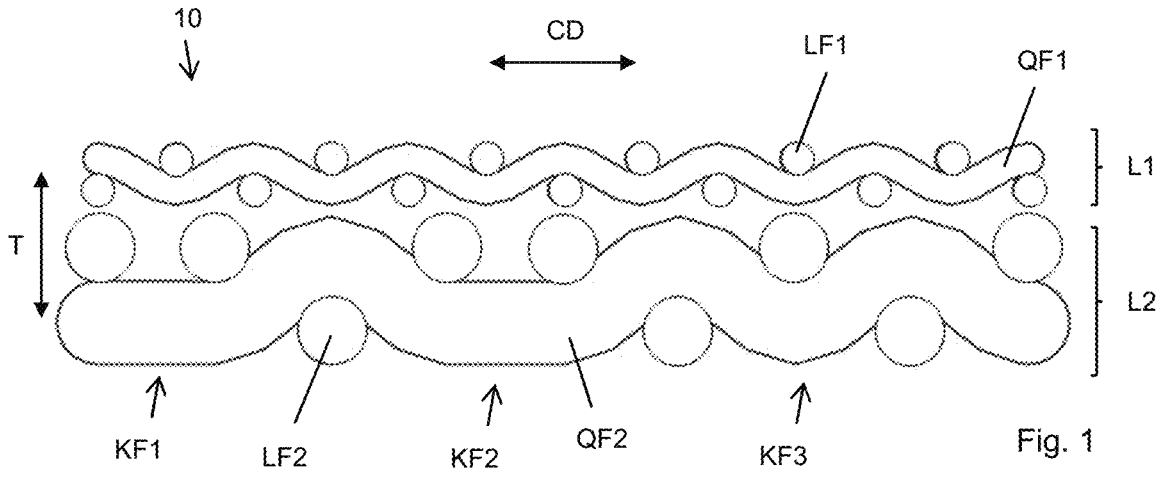
FIG. 1 shows a schematic illustration of a first embodiment of a clothing according to the invention in cross section, which has three contact flotations of a length of two, two and one per repeat.

FIG. 1 in a schematic illustration shows a first embodiment of a clothing 10 according to the invention in cross section. The section plane shown here is defined by the clothing cross direction CD and the thickness direction T. This embodiment is distinguished in particular in that it has three contact flotations KF1, KF2 and KF3 per repeat, which have a length of two, two and one, respectively.

To be seen in FIG. 1 is a first woven-fabric layer L1 which provides a web contact side (at the top in FIG. 1), and a second woven-fabric layer L2 which provides a machine contact side disposed therebelow (at the bottom in FIG. 1). Both woven-fabric layers L1 and L2 are connected to one another by pairs of binding threads which extend substantially in the woven-fabric cross direction CD. The first woven-fabric layer L1 comprises first transverse threads QF1 which are interwoven with first longitudinal threads LF1. As is shown in FIG. 1, the first transverse threads QF1 can be mutually interwoven with the first longitudinal threads LF1 in a plain weave, so as to configure the first woven-fabric layer L1. Similarly, the second woven-fabric layer L2 comprises second transverse threads QF2 which are interwoven with second longitudinal threads LF2. The woven fabric 10 according to the invention here furthermore has the peculiarity that it comprises more first longitudinal threads LF1 than second longitudinal threads LF2, in this exemplary embodiment specifically 1.5 times as many first longitudinal threads LF1 as second longitudinal threads LF2. The first longitudinal threads LF1 as well as the first transverse threads QF1 have a noticeably smaller cross section than the second longitudinal threads LF2 and/or the second transverse threads QF2. In this way, a particularly fine and low-marking paper contact face of the first woven-fabric layer L1 can be provided, while the tensile loads which act on the clothing 10 in the intended use are primarily absorbed by the second woven-fabric layer L2.

The second transverse threads QF2 on the machine contact side (at the bottom in FIG. 1) of the clothing 10 have flotations, specifically so-called contact flotations KF1, KF2 and KF3, all of which are kept short, i.e. only guided below a second longitudinal thread or at most below two longitudinal threads disposed directly next to one another. This has an advantageous effect on the transverse stability of the clothing 10. The thickness of the clothing 10 in the region of the contact flotations KF1, KF2 and KF3 is reduced in comparison to the clothing with longer contact flotations known from WO 2008/068317 A1.

Figure 2:
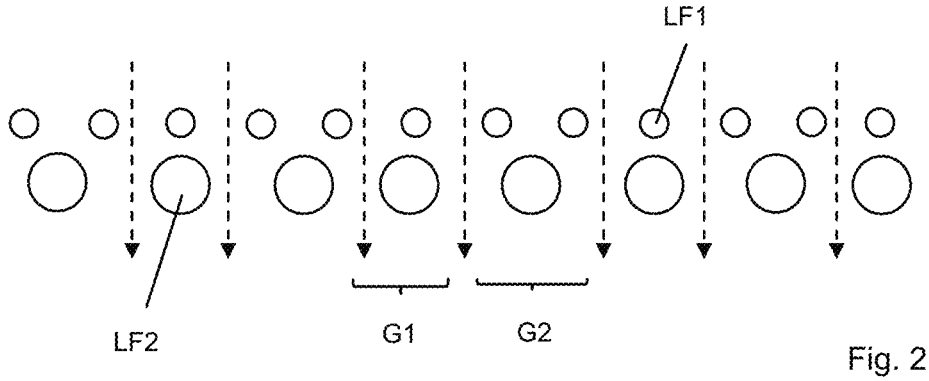
FIG. 2 shows a schematic illustration of only the first and the second longitudinal threads of FIG. 1, which are disposed in groups.

FIG. 2, in a schematic illustration, shows only the first longitudinal threads LF1 and the second longitudinal threads LF2 from FIG. 1 per repeat, but not the various transverse threads. It is highlighted by this illustration that the first longitudinal threads LF1 and the second longitudinal threads LF2 in each repeat are disposed in a plurality of groups G1 and G2, specifically at least one first group G1 and one second group G2, wherein the first group G1 is formed from one first longitudinal thread LF1 and one second longitudinal thread LF2 which are disposed exactly on top of one another in the thickness direction T of the clothing 10, while the second group G2 is formed from two first longitudinal threads LF1 and one second longitudinal thread LF2, wherein none of the two first longitudinal threads LF1 of the second group G2 is disposed exactly above the one second longitudinal thread LF2 of the second group G2 in the thickness direction T of the clothing 10. In the present exemplary embodiment, the two groups G1 and G2 continually alternate with one another. The first longitudinal threads LF1 and the second longitudinal threads LF2 here are dimensioned and disposed relative to one another in such a manner that, when viewed projected in the thickness direction T of the clothing 10, said threads within a repeat form at least one free longitudinal strip, wherein such a strip is preferably formed at all locations where different groups G1, G2 are adjacent to one another. The free longitudinal strips facilitate the de-watering of the material web on the material contact side (at the top in FIG. 1) toward the machine contact side (at the bottom in FIG. 1), this being illustrated by arrows in dashed lines in FIG. 2. The term "free longitudinal strip" consciously does not take into account that the transverse threads, not shown in FIG. 2, may impede the free de-watering, or at least in portions in the longitudinal direction of the clothing 10 (orthogonal to the image plane in FIG. 1 or 2) obstructs rectilinear de-watering in the thickness direction T of the clothing 10, from the web contact side of the clothing 10 to the machine contact side of the clothing 10.

Figure 3A:
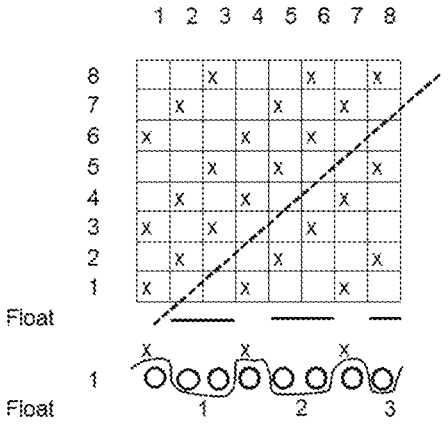
FIG. 3*a* shows the weaving pattern of a first variant of the second layer of the woven fabric of FIG. 1, having a regular, non-interrupted twill weave.
Figure 3B:
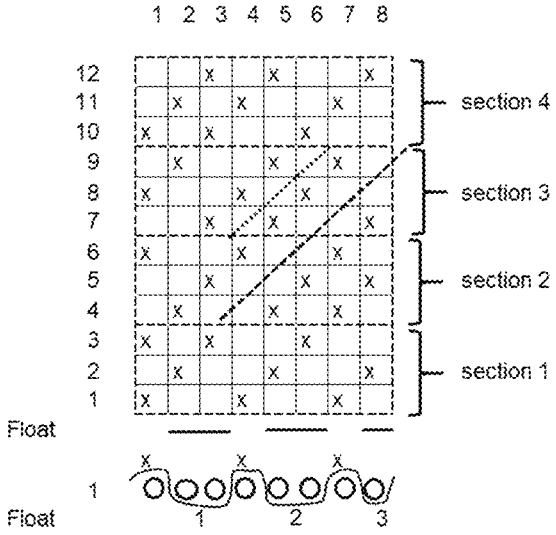
FIG. 3*b* shows the weaving pattern of a second variant of the second layer of the woven fabric of FIG. 1, having an interrupted twill weave.

FIGS. 3*a* and 3*b* show two different variants of the weaving pattern of the second layer L2 of the clothing 10 from FIGS. 1 and 2. The columns of this chessboard-like illustration of the weaving pattern correspond to the second longitudinal threads LF2, whereas the lines correspond to the second transverse threads QF2. Where an "x" is marked in the box, the corresponding second transverse thread QF2 at the top, i.e. toward the web contact side of the clothing 10, is guided over a corresponding second longitudinal thread LF2. Conversely, where there is no "x" in the box, or the box is empty, the corresponding second transverse thread QF2 is guided below the corresponding second longitudinal thread LF2, thus forming a contact flotation KF1, KF2 or KF3 on the machine contact side of the clothing 10. Shown once again below the weaving pattern, for the purpose of visualization, is the profile of the weaving path of a second transverse thread QF2, specifically of that second transverse thread denoted as number 1 in the weaving pattern illustrated thereabove.

The two variants shown in FIGS. 3*a* and 3*b* differ from one another in that the second layer L2 in the first variant according to FIG. 3*a* has a regular, non-interrupted twill weave, whereas the second layer L2 in the second variant according to FIG. 3*b* has an interrupted twill weave. The rib of the respective twill weave is indicated by a diagonally running dashed line in FIGS. 3*a* and 3*b*. In the second variant according to FIG. 3*b*, the 12 second transverse threads QF2 of the repeat can be subdivided into 4 groups, or portions, of identical size, wherein each group, or each portion, per se again has a regular, non-interrupted twill weave.

FIGS. 4 and 5 show once again in more detail the weaving pattern of the first variant according to FIG. 3*a*, wherein "in more detail" here means that the weaving paths of all threads in one repeat of the clothing 10 are illustrated in FIG. 5, thus also the weaving paths of the first longitudinal threads LF1 and the first transverse threads QF1 of the first layer L1, and the weaving paths of the binding threads connecting the two layers L1 and L2. Accordingly, there is a different numbering of the second longitudinal threads LF2 and second transverse threads QF2 of the second layer L2 in FIG. 4 in comparison to FIG. 3*a*, whereby FIG. 4 otherwise corresponds to FIG. 3*a*. Each second pair of threads extending substantially in the cross direction in FIG. 5 is a pair of binding threads, wherein illustrated by a dotted line in each case is one binding thread of the pair of binding threads. The binding threads, conjointly with the first transverse threads QF1 and the first longitudinal threads LF1, form a plain weave on the web material contact side.

Figure 4:
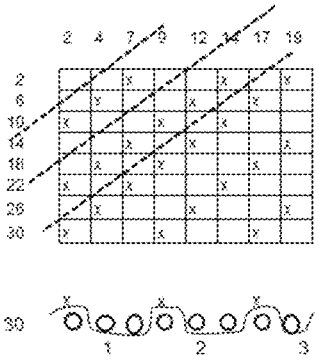
FIG. 4 shows the weaving pattern as in FIG. 3*a*, but with a somewhat different numbering.
Figure 5:
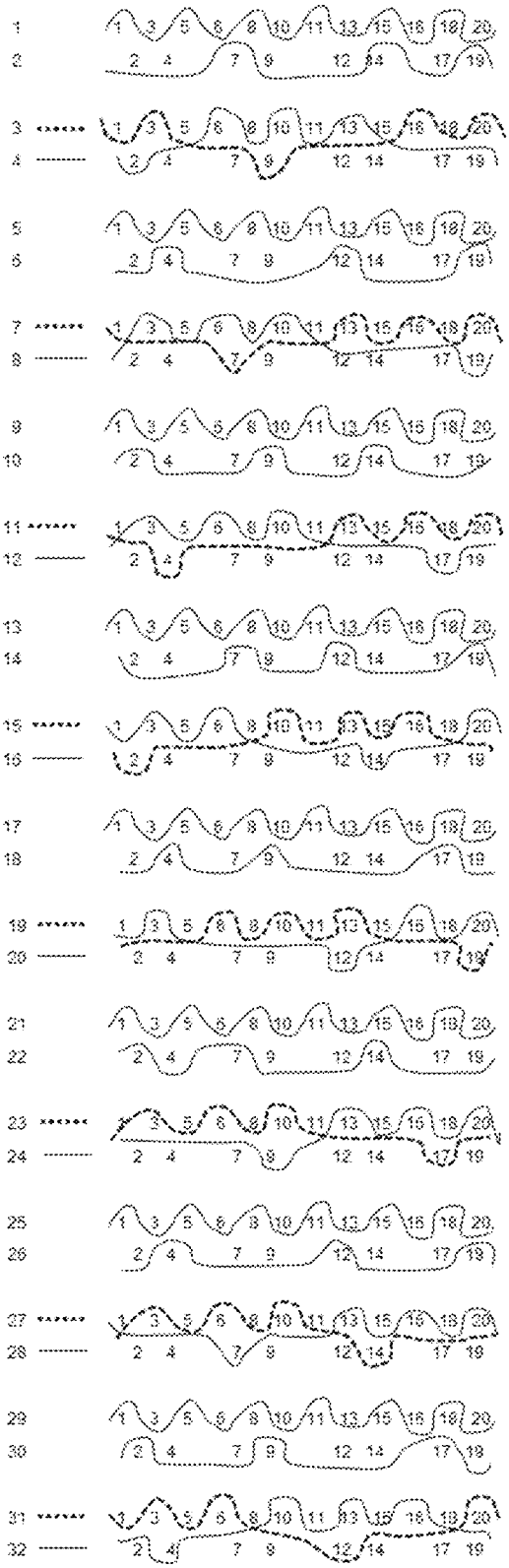
FIG. 5 shows the complete weaving paths of all of the threads running in the clothing cross direction, including the binding threads, of the clothing according to the invention according to FIG. 4 within one repeat.

FIG. 4 shows that the second woven-fabric layer L2, in the case of the first variant of the first embodiment too, is a multi-rib twill, because there are two twill ribs of dissimilar widths.

Figure 6:
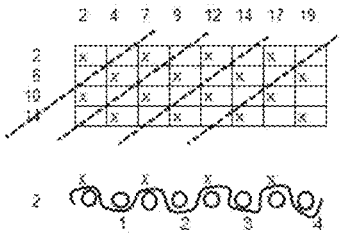
FIG. 6 shows the weaving pattern of the second layer of a second embodiment of the clothing according to the invention, which has four contact flotations per repeat, each having a length of one, having a plain weave.
Figure 7:
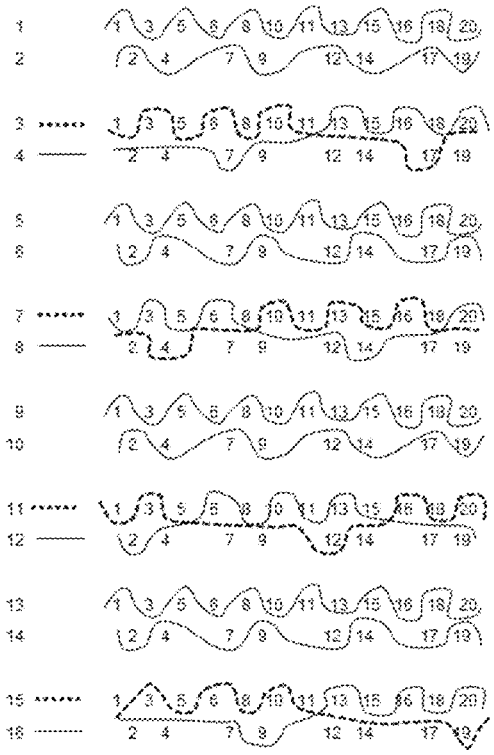
FIG. 7 shows the complete weaving paths of all of the threads running in the clothing cross direction, including the binding threads, of the clothing according to the invention according to FIG. 6 within one repeat.

FIGS. 6 and 7 show the weaving paths of a second embodiment of the clothing according to the invention. The latter differs from the first embodiment primarily in that the second layer has four contact flotations per repeat, wherein each individual contact flotation has a length of one. In this way, the second layer has a plain weave. The type of illustration of the second embodiment corresponds to that of FIGS. 4 and 5 for the first embodiment, respectively.

Figure 8:
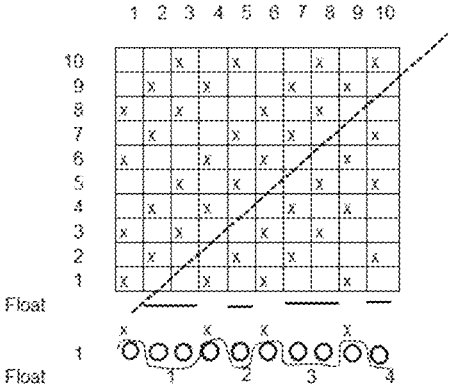
FIG. 8 shows the weaving pattern of the second layer of a third embodiment of the clothing according to the invention, which has four contact flotations having a length of two, one, two and one per repeat, having a regular, non-interrupted twill weave.
Figure 9:
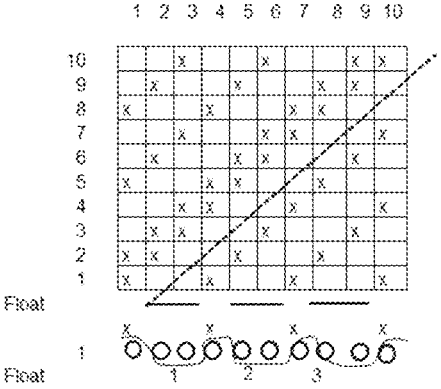
FIG. 9 shows the weaving pattern of the second layer of a fourth embodiment of the clothing according to the invention, which has four contact flotations having a length of two, two, two and one per repeat, having a regular, non-interrupted twill weave.

Two further embodiments of the clothing according to the invention are illustrated in FIGS. 8 and 9, wherein the illustration corresponds to that in FIGS. 3*a* and 3*b*, because only the weaving pattern of the second layer per repeat is also shown here. The third embodiment according to FIG. 8 is distinguished in that there are four contact flotations per repeat, which have a length of two, one, two and one. In contrast, the fourth embodiment according to FIG. 9 is distinguished in that there are only three contact flotations which have in each case a length of two. The second woven-fabric layer, in the third as well as the fourth embodiment, has in each case a regular, non-interrupted multi-rib twill weave.

Figure 10A:
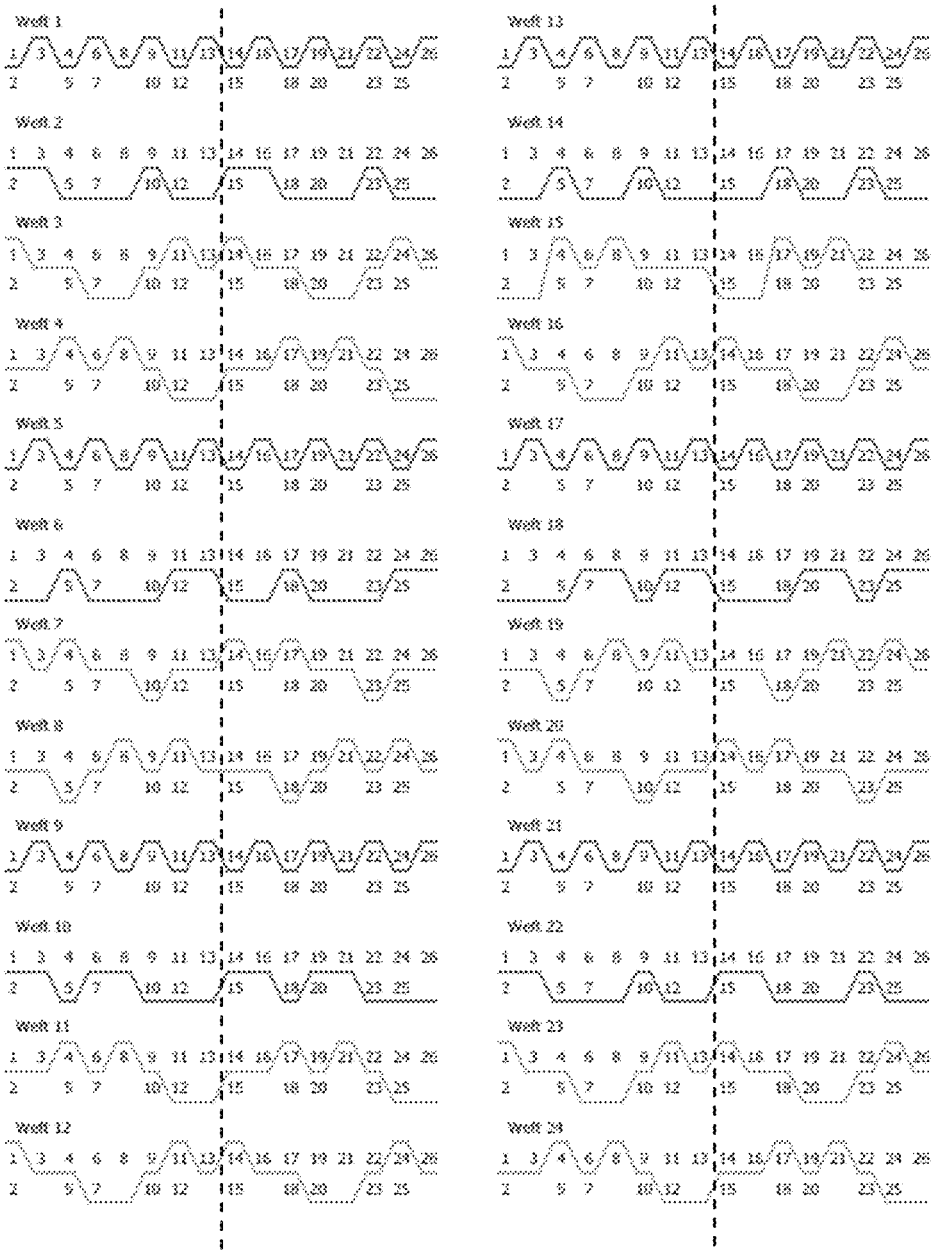
FIGS. 10*a-b* show the complete weaving paths of all of the threads running in the clothing cross direction, including the binding threads, of the clothing according to the invention according to a third embodiment.
Figure 10B:
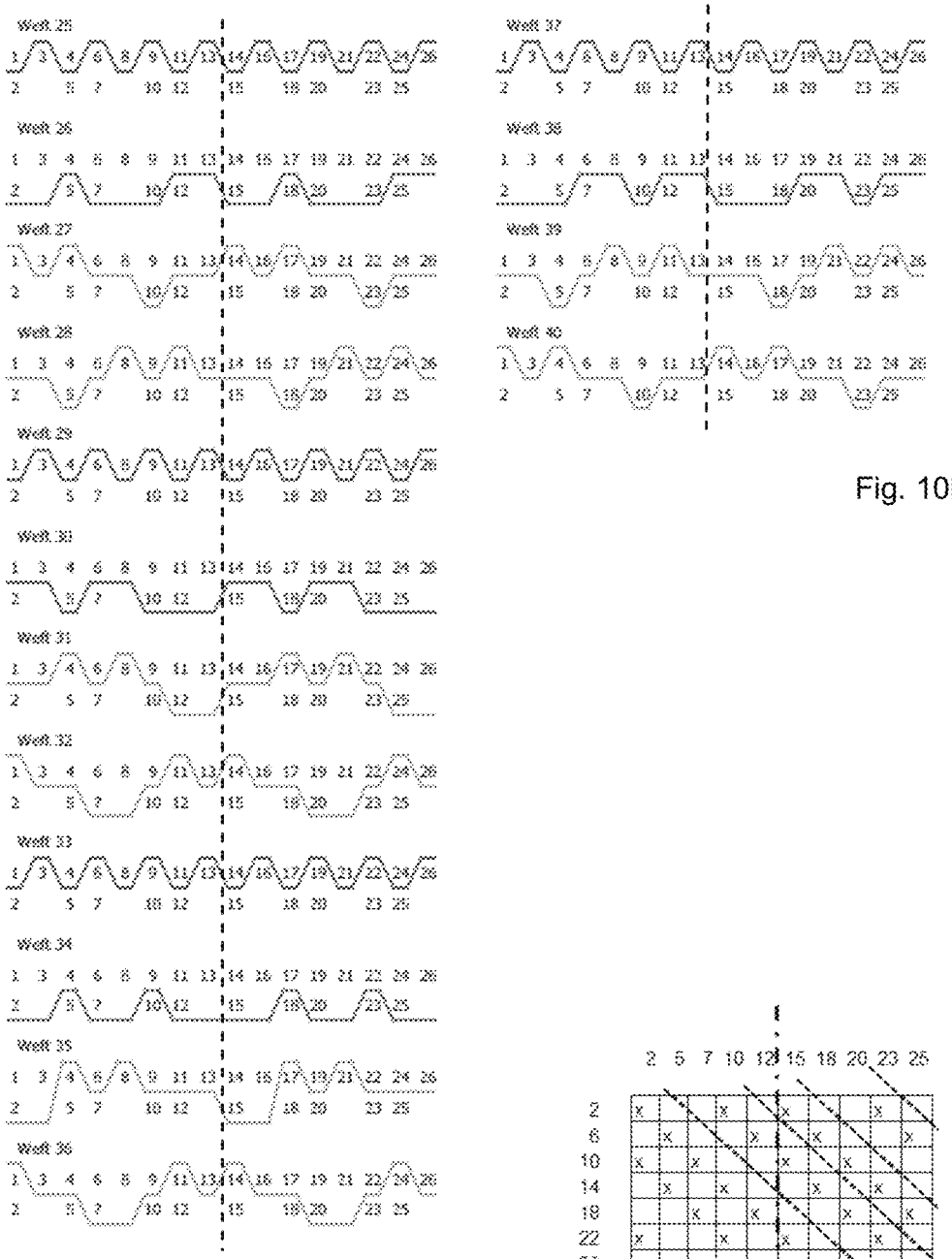
Figure 11:
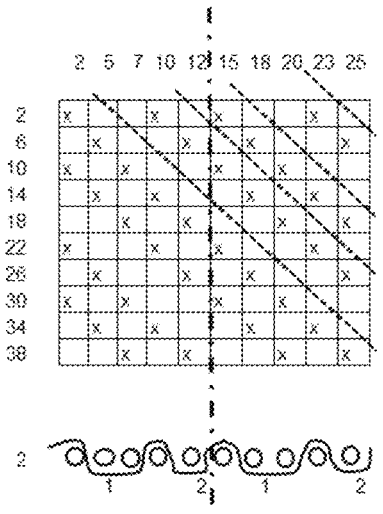
FIG. 11 shows the weaving pattern of only the second layer of the woven fabric of the third embodiment according to FIGS. 10*a-b*, having a regular, non-interrupted twill weave.

FIGS. 10*a*, 10*b* and 11 describe a third, particularly preferred embodiment of the present invention. FIGS. 10*a* and 10*b* show the entire profile of the first transverse threads QF1, the second transverse threads QF2 and the binding threads relative to the first longitudinal threads LF1 and the second longitudinal threads LF2 in two complete repeats of the clothing 10. In FIGS. 10*a* and 10*b*, the first transverse threads QF1, the second transverse threads QF2 and the binding threads, which all extend in the cross direction of the clothing, are denoted as Weft 1 to Weft 40, whereas the first longitudinal threads LF1 and the second longitudinal threads are simply numbered using the numerals 1 through 26. As can be gathered from these figures, a complete repeat thus comprises eight first longitudinal threads LF1, specifically the longitudinal threads numbered 1, 3, 4, 6, 8, 9, 11 and 13, whereas the longitudinal threads numbered 14, 16, 17, 19, 21, 22, 24 and 26 only represent a first repetition, and five second longitudinal threads LF2, specifically the longitudinal threads numbered 2, 5, 7, 10 and 12, whereas the longitudinal threads numbered 15, 18, 20, 23 and 25 only represent a first repetition. In this way, the ratio of first longitudinal threads LF1 to second longitudinal threads LF2 is 8:5. This differentiates the third embodiment from the first two embodiments, in which this ratio was 3:2. In this way, particularly fine surfaces can be formed on the web material contact side.

In a manner similar to what has been described in the context of the first embodiment in FIG. 4, FIG. 11 shows only the weaving pattern of the second woven-fabric layer L2, illustrated twice next to one another. In the present third exemplary embodiment, each second transverse thread QF2 of a complete repeat of the second layer L2 has in each case two contact flotations, specifically one of the length 1, and one of the length 2. By way of example, a specific weaving path is illustrated once again at the bottom in FIG. 11, specifically that from the second transverse thread QF2 numbered 2, according to the uppermost line in the chessboard-like illustration thereabove.

As can furthermore be gathered from FIG. 11, the second layer L2 has a regular, non-interrupted twill weave, wherein the widths of the ribs differ from one another, however. This is therefore a multi-rib twill here too.

LIST OF REFERENCE SIGNS

10 Clothing
CD Clothing cross direction
G1 First group
G2 Second group
KF1 First contact flotation
KF2 Second contact flotation
KF3 Third contact flotation
L1 First layer
L2 Second layer
LF1 First longitudinal thread
LF2 Second longitudinal thread
QF1 First transverse thread
QF2 Second transverse thread
T Thickness direction

The invention claimed is:

1. A clothing for a machine for producing or processing a material web, the clothing comprising:

a first woven-fabric layer forming a web material contact side, said first woven-fabric layer being formed by interwoven first longitudinal threads that run in a clothing longitudinal direction and first transverse threads that run in a clothing cross direction; and a second woven-fabric layer forming a machine contact side, said second woven-fabric layer being formed by interwoven second longitudinal threads that run in the clothing longitudinal direction and second transverse threads that run in the clothing cross direction;

said first woven-fabric layer and said second woven-fabric layer being connected to one another via binder threads;

a number of first longitudinal threads in the clothing being greater than a number of second longitudinal threads, but being at most double the number of second longitudinal threads; and a weaving pattern of the clothing recurring in repeats, and the second transverse threads in each repeat forming at least two contact floats on the machine contact side, with all contact floats of the second transverse threads having a length of at most two;

said first longitudinal threads and said second longitudinal threads in each repeat being disposed in a plurality of groups, with at least one first group and one second group, wherein the first group is formed of one first longitudinal thread and one second longitudinal thread that are disposed exactly on top of one another in a thickness direction of the clothing, while the second group is formed of two first longitudinal threads and one second longitudinal thread, and wherein none of the two first longitudinal threads of the second group is disposed exactly above the one second longitudinal thread of the second group in the thickness direction of the clothing.

2. The clothing according to claim 1, wherein said first longitudinal threads and said second longitudinal threads are dimensioned and disposed relative to one another in such a manner that, when viewed in a projection in the thickness direction of the clothing, said threads within a repeat form at least one free longitudinal strip.

3. The clothing according to claim 2, wherein the at least one free longitudinal strip is formed at all locations where different groups are disposed adjacent one another.

4. The clothing according to claim 1, wherein a number of said first groups differs from a number of said second groups in the clothing.

5. The clothing according to claim 1, wherein said second transverse threads form at most six contact floats on the machine contact side in each repeat.

6. The clothing according to claim 1, wherein the binding threads always run in pairs beside one another in the clothing cross direction, and said binding threads continue a weaving pattern on the web material contact side.

7. The clothing according to claim 6, wherein the binding threads continue the weaving pattern on the web material contact side in an alternating manner.

8. The clothing according to claim 1, wherein said first woven-fabric layer has a plain weave.

9. The clothing according to claim 1, wherein said first woven-fabric layer has a twill weave.

10. The clothing according to claim 9, wherein the twill weave of said first woven-fabric layer is a 2/1 twill weave.

11. The clothing according to claim 9, wherein the twill weave of said first woven-fabric layer is a 3/1 twill weave.

12. The clothing according to claim 9, wherein the twill weave of said first woven-fabric layer is a broken twill weave.

13. The clothing according to claim 9, wherein the twill weave of said first woven-fabric layer is a non-broken twill weave.

14. The clothing according to claim 1, wherein said second woven-fabric layer has a non-broken twill weave.

15. The clothing according to claim 1, wherein said second woven-fabric layer has a broken twill weave.

16. The clothing according to claim 1, wherein two neighboring contact floats of the second transverse thread are separated from one another by at most two second longitudinal threads.

17. The clothing according to claim 15, wherein two neighboring contact floats of the second transverse thread are in each case separated from one another by only one second longitudinal thread.

18. The clothing according to claim 1, being a forming screen for processing a tissue web.

19. The clothing according to claim 1 configured for producing a tissue web having a specific area weight between 8 $g/m^2$ and 30 $g/m^2$.

* * * * *